United States Patent [19]

Anderson

[11] Patent Number: 4,898,386

[45] Date of Patent: Feb. 6, 1990

[54] TRAINING BAT

[76] Inventor: Donald A. Anderson, 5367 Brandy La., Sylvania, Ohio 43560

[21] Appl. No.: 309,696

[22] Filed: Feb. 10, 1989

[51] Int. Cl.[4] ..... A63B 69/06

[52] U.S. Cl. ..... 273/26 B

[58] Field of Search ..... 273/26 B, 186 A, 193 R, 273/193 A, 67 R, 72 R, 183 D, 187 R

[56] References Cited

U.S. PATENT DOCUMENTS

| | | | |
|---|---|---|---|
| 514,420 | 2/1894 | Jacobus | 273/72 R |
| 2,379,006 | 6/1945 | Johnson | 273/26 B |
| 3,116,926 | 6/1964 | Owen et al. | 273/26 B |
| 3,137,504 | 6/1964 | Zordan et al. | 273/26 B |
| 3,578,801 | 5/1971 | Piazza | 273/26 B |
| 3,762,720 | 10/1973 | Jett | 273/183 D |
| 3,806,130 | 4/1974 | Jacques | 273/183 D |
| 3,897,058 | 7/1975 | Kock | 273/26 B |
| 3,931,968 | 1/1976 | Hedberg | 273/75 |
| 4,027,879 | 6/1977 | Wright | 273/29 A |
| 4,113,248 | 9/1978 | Yanagioka | 273/72 A |
| 4,317,567 | 3/1982 | Blake | 273/26 B |
| 4,671,508 | 6/1987 | Tetreault | 273/26 B |

*Primary Examiner*—T. Brown

*Attorney, Agent, or Firm*—Emch, Schaffer, Schaub & Porcello Co.

[57] ABSTRACT

A training bat comprising a hollow cylindrical bat having a handle end and a striking end. A disk is positioned in the interior of the bat at substantially the center of the bat. A plate is positioned in the interior of the bat at substantially the end of the striking end of the bat. An object is slideably position in the interior of the bat and the object is moveable between the disk and the plate. A hollow chamber is positioned in the handle end of the bat and the chamber is disposed for receiving a weight. A knob is removably positioned on the end of the handle end of the bat whereby the knob closes the end of the hollow chamber.

11 Claims, 1 Drawing Sheet

TRAINING BAT

BACKGROUND OF THE INVENTION

The field of the invention is a training bat that can be used to improve the swing of a baseball or softball player. More particularly, the device relates to a training bat that provides an audible sound that allows the hitter to recognize when the bat has been properly swung, a bat that can be utilized to improve the strength of the hitter and a bat that can be utilized to improve the speed at which the batter can swing the bat.

In the past, training bats have been primarily heavy bats utilized to loosen-up the hitter prior to using a normal weight and size bat. This can be accomplished by adding a very heavy weight for a practice bat or by attaching a weight such as a round doughnut to the bat the player is actually going to use to hit a ball. These bats are usually very heavy and actually disrupt the swing utilized by the player. The weight for the bat is usually concentrated on the end of the bat that is spaced apart from the hitter's hands and this greatly disrupts the balance of the bat and places a great deal of strain on the arms, shoulders and back of the hitter. This type of improperly weighted bat also greatly disrupts the swing of the hitter and cannot effectively be utilized as a training device to improve the hitter's swing.

There have also been prior art bats having a moveable weight that would produce an audible sound to signify to the hitter when the bat is being properly swung. On these bats the weight is usually fairly heavy and movement of the weight in the bat disrupts the balance of the bat and the swing by the hitter. The moveable weight can also place additional strain on the shoulders, arms and back of the hitter which is not desirable. If the moveable weight is heavy enough it is also possible that the movement of the weight can place enough stress on the hitter that the bat will come loose from the hitter's hands. This is obviously a serious safety problem that limits the usefulness of such a bat. It should be noted that having the bat released from the hitter's hands unintentionally can also be a problem with the heavy, poorly balanced bats discussed above.

In view of the above limitations in the prior art, there is a need in the industry for a training bat that can produce an audible signal to the hitter when the bat is properly swung where the mechanism for producing the audible signal does not significantly alter the balance of the bat. There is also a need for a bat that can have its weight increased so that the bat can be utilized to increase the strength of a hitter without disrupting the balance of the bat or creating a safety problem. There is also a need for such a bat where the weight of the bat can be reduced without seriously effecting the balance of the bat so that the bat can be utilized to increase the velocity at which the hitter can swing a bat. These and other advantages will be provided by the training bat set forth in this patent application.

SUMMARY OF THE INVENTION

A training bat comprising a hollow cylindrical bat having a handle end and a striking end. A disk is positioned in the interior of the bat at substantially the center of the bat. A plate is positioned in the interior of the bat at substantially the end of the striking end of the bat. An object is slideably position in the interior of the bat and the object is moveable between the disk and the plate. A hollow chamber is positioned in the handle end of the bat and the chamber is disposed for receiving a weight. A knob is removably positioned on the end of the handle end of the bat whereby the knob closes the end of the hollow chamber.

DESCRIPTION OF THE PREFERRED EMBODIMENTS

Figure 2:
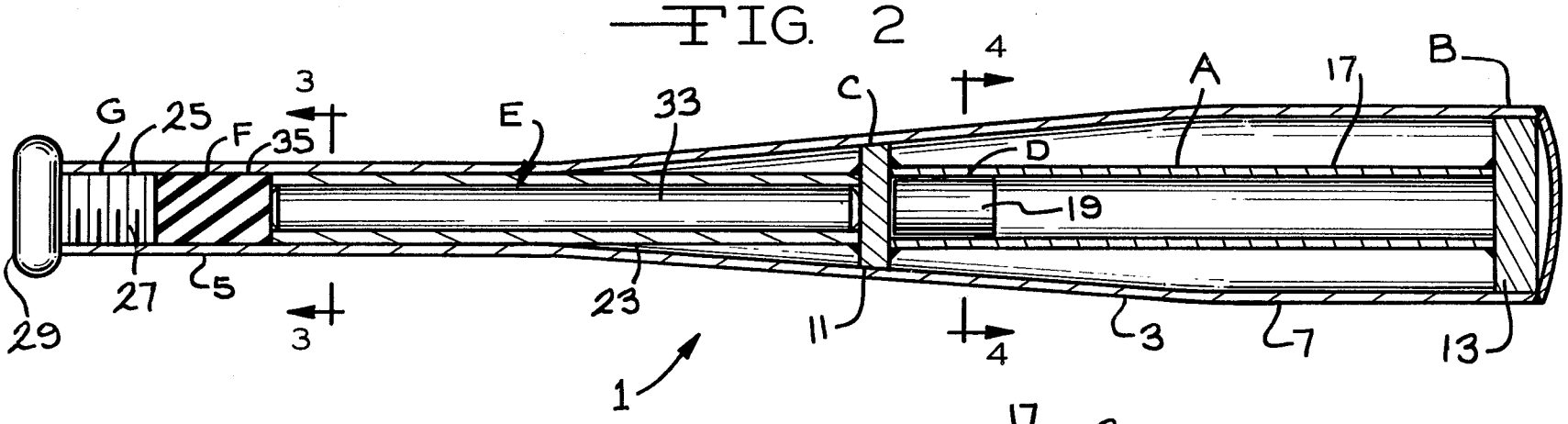
FIG. 2 is a cross-sectional view taken along the centerline of the bat shown in FIG. 1.
Figure 4:
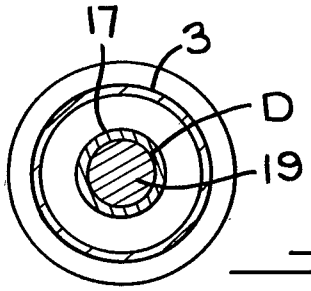
FIG. 4 is a cross-sectional view taken along line 4—4 of FIG. 2.
Figure 3:
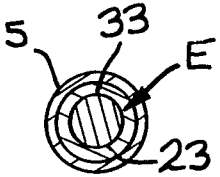
FIG. 3 is a cross-sectional view taken along line 3—3 of FIG. 2.
Figure 1:
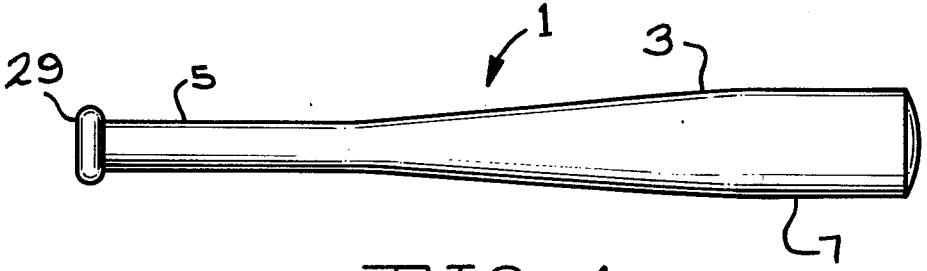
FIG. 1 is a side elevational view of the bat of the present invention.

The invention is directed to a training bat that can be utilized to improve the swing and increase the strength of a baseball or softball player. More particularly, the bat provides an audio signal when the bat has been swung properly and the weight of the bat can be varied to allow the user to work on developing additional strength or bat speed. The features of the invention will be more readily understood by referring to the attached drawings in connection with the following description.

The training bat 1 comprises a hollow generally cylindrical bat 3 having a handle end 5 and a hitting end 7. Normally the bat is constructed of aluminum but it should be understood that other metals or plastics can be used to form the outer shell of the hollow bat. A disk 11 is positioned in the interior of the bat with the disk secured to the outer walls of the bat. The disk 11 is positioned substantially in the center of the bat and the disk is substantially perpendicular to the longitudinal axis of the bat. Usually the disk 11 is made from the same material as the outer walls of the cylindrical bat 3. However, it should be understood that the disk 11 can be made of some other materials such as other metals, plastics or wood.

A striking plate 13 is positioned in the interior of the bat at substantially the end of the hitting end 7 of the bat. The striking plate 13 is securly attached to the outer walls of the cylindrical bat 3. Normally the striking plate 13 is made of the same metal of the outer wall of the cylindrical bat 3, however, it should be understood that other materials as previously described for the disk 11 can be used for the striking plate 13. The striking plate 13 is disposed so that it is substantially perpendicular to the longitudinal axis of the training bat 1.

A hollow tube 17 is positioned in the interior of the cylindrical bat 3 and extends from the disk 11 to the striking plate 13. The hollow tube 17 is secured to the disk 11 and the striking plate 13 and is usually positioned substantially parallel to and concentric with the centerline of the cylindrical bat 3. The hollow tube 17 can be made of a suitable metal or plastic material. An object 19 is slideably positioned in the hollow tube 17. The object is moveable between the disk 11 and the striking plate 13. Normally, the object 19 is a metal slug that can freely move from the disk 11 to the striking plate 13 when the cylindrical bat 3 is swung. It should be understood that other materials can be utilized for the object 19 but it is important that the object 19 have a weight that is relatively small in comparison to the overall weight of the training bat 1 and that the object be capable of making an audible sound when the object hits the striking plate 13.

A hollow chamber 23 is located in the handle end of the bat. The chamber extends from the disk 11 to the end of the handle end of the cylindrical bat 3. A plurality of threads 25 are positioned on the end of the hollow chamber 23 that is spaced apart from the disk 11. The threads 25 are located on the periphery of the hollow chamber 23. A threaded projection 27 having a knob 29 positioned on one end is disposed for threadingly engaging the threads 25 in the hollow chamber 23. When the threaded projection 27 is threaded all the way onto the threads 25 of the hollow chamber 23, the knob 29 extends across the end of the cylindrical bat 3 and closes the end of the hollow chamber 23. The knob 29 is disposed so that it is substantially perpendicular to the longitudinal axis of the hollow chamber 23. A weight 33 can be positioned in the hollow chamber 23 of the cylindrical bat 3. The weight is normally a metal rod that extends from the disk 11 substantially to the threaded projection 27 that is positioned on the end of the hollow chamber 23. A resilient member 35 can be positioned between the threaded projection 27 and the weight 33 so that the resilient member bears against the weight to keep the weight from moving in the hollow chamber 23. It should be noted that metal rods having different weights can be inserted into the hollow chamber 23 to change the overall weight of the training bat 1.

In operation, the training bat 1 can be utilized to develop additional strength or to improve bat speed for the hitter. However, in either application the hitter is given an audible signal when the bat is swung properly to provide the maximum force to a ball that is to be struck.

To use the bat, the hitting end 7 of the bat 1 is elevated so that the object 19 in the hollow tube 17 is positioned against the disk 11. As the bat is swung, the object 19 will advance along the hollow tube 17 and hit the striking plate 13 located at the hitting end of the training bat 1. The object 19 should hit the striking plate 13 at substantially the position where the hitter would be contacting a ball during the swing. Accordingly, the bat produces an audible sound that allows the hitter and coaches working with the hitter to determine if the bat is being swung in the proper manner to deliver the maximum amount of force to the ball. After each swing it is only necessary to slightly elevate the hitting end 7 of the training bat 1 to reposition the object 19 against the disk 11 so that the bat can again be used to develop the proper swing for hitting a ball. As the object 19 is very light in comparison to the overall weight of the bat there is no significant change in the balance of the bat, or no sudden jolt experienced by the hitter as the object moves from the disk 11 to the striking plate 13. It is also possible to use this bat to actually strike a ball so that the hitter will know if the object 19 hits the striking plate 13 when the ball is acutally hit or if the sound occurs at a different point in the swing indicating maximum force has not been transferred to the ball. In most applications it is recommended that a tennis ball or a wiffle ball be used for these training purposes but it is possible to use a baseball or softball with the training bat 1.

If the hitter desires to incrase strength while practicing his swing, weights 33 can be inserted into the hollow chamber 23 in the handle end 5 of the cylindrical bat 3 to increase the weight of the practice bat over the weight of a normal bat. The hitter can select the amount of additional weight desired in the bat and insert such appropriate weight into the hollow chamber 23. The weight 33 is held in place by the resilient member 35 so that the weight does not move during the swinging of the bat. This is very significant as the balance of the bat does not change during the swing and there are no sudden jolts of shocks which can be encountered such as when there is a moveable weight utilized with a training bat. This reduces stresses on the arms and shoulders of the user and also eliminates the possibility of a sudden change in the balance of the bat causing the bat to fly from the hands of the user. Having the additional weight concentrated in the handle end of the bat is very effective for strengthening the hands, wrist and forearms of the hitter. When a weight is added to the hitting end of the bat, the weight has a tendency to provide too much force that disrupts the swing of the hitter and provides a great deal of strain on the upper arms, shoulders and back of the hitter. The force generated by the weight on the end of the back is also much more likely to result in the bat being pulled from the hitter's hands which can be a very dangerous situation. Adding a weight to the hollow chamber 23 in the handle end 5 of the training bat 1 proves a very safe and effective way to develop additional strength without disrupting the swing of the hitter. At the same time the moveable object 19 reminds the user to swing in the proper manner so that the object strikes the striking plate 13 at the proper position in the swing. thus, even when using this training bat to increase strength, the hitter is given an audible signal to tell whether or not the bat is being swung in a proper manner to deliver the maximum amount of force to a ball that is to be hit.

If the user of the training bat 1 is interested in increasing bat speed, the weight 33 can be significantly reduced or removed totally from the handle end 5 of the bat. When the weight is removed the training bat 1 is lighter than a normal bat and allows the user to swing the bat in a manner that is faster than a normally weighted bat can be swung. This training can be very effective in allowing the user to increase the speed at which a bat can be swung when the user is actually trying to hit a ball. Since the velocity of a bat is very important in determining the amount of force that is transferred from the bat to the ball, this is very effective training for the user. At the same time, the moveable object 19 provides the same audible signal to tell the batter whether or not the bat is being swung in a proper manner as described above. Thus, when the training bat 1 is being used to increase bat speed, the user is still reminded to use the bat in the proper manner to deliver maximum force to the ball that is to be stuck.

Utilizing the training bat of the present invention allows a hitter to use a bat having the same approximate weight as the regular bat used by the hitter to determine if the bat is being swung in a manner to deliver maximum force to the ball that is to be struck. The moveable object 19 in the hollow chamber 23 provides a audible signal by striking the striking plate 13 and if the signal is produced at substantially the position when the bat would be hitting the ball the user knows the bat has been swung properly. By varying the weights in the handle of the bat, the user can also use the bat to develop additional strength for hitting stroke and also to increase the speed at which the bat is swung through the hitting stroke. When the bat is used to increase speed and strength there is still the audible signal that reminds the user to swing the bat in the proper manner. This bat can be used either individually by a hitter or with a coach providing instruction to greatly enhance the ability of a batter to provide maximum force to a ball that is to be hit.

The above description is given for the sake of explanation. Various modifications and substitutions, other than those cited, can be made without departing from the scope of the invention as defined by the following claims.

I claim:

1. A training bat comprising:

a hollow cylindrical bat having a handle end and a striking end;

a disk positioned in the interior of said bat, said disk being positioned substantially in the center of said bat;

a plate positioned in the interior of said bat at substantially the end of said striking end of said bat;

an object slideably positioned in the interior of said bat, said object being moveable between said disk and said plate;

a hollow chamber positioned in said handle end of said bat, said chamber disposed for receiving a weight;

a knob removably positioned on the end of said handle end of said bat, whereby said knob closes said end of said chamber.

2. The bat of claim 1, wherein a hollow tube is positioned in the interior of said bat and extends from said disk to said striking plate, said object being moveably positioned in said tube.

3. The bat of claim 2, wherein said object is a cylindrical metal slug.

4. The bat of claim 2, wherein said object has a weight that is very small in comparison to the overall weight of said bat.

5. The bat of claim 1, wherein a plurality of threads are positioned in said end of said chamber at the end of said handle end of said bat.

6. The bat of claim 5, wherein said hollow chamber extends from said disk to said end of said handle end of said bat.

7. The bat of claim 6, wherein a weight is positioned in said hollow chamber, said weight extending from said disk towards said threaded projection on said knob.

8. The bat of claim 7, wherein a resilient member is positioned between said threaded projection of said knob and said weight, said resilient member contacting said weight to keep said weight from moving in said chamber.

9. The bat of claim 8, wherein said bat is considerably lighter than a conventional bat of the same size when there is not a weight in said chamber and said weight of said bat can be increased considerably over the weight of a conventional bat by placing weights in said chamber.

10. The bat of claim 5, wherein said knob has a threaded projection that extends from one side of said knob, said threaded projection being disposed for threadingly engaging said threads in said chamber.

11. A training bat comprising:

a hollow cylindrical bat having a handle end and a striking end;

a disk positioned in the interior of said bat, said disk being positioned substantially in the center of said bat;

a plate positioned in the interior of said bat at substantially the end of said striking end of said bat;

a hollow tube positioned in the interior of said bat and extending from said disk to said plate;

an object slideably positioned in said tube, said object being moveable between said disk and said plate;

a hollow chamber positioned in said handle end of said bat, said chamber extending from said end of said handle end of said bat to said disk;

a plurality of threads positioned in said chamber adjacent said end on said handle end of said bat;

a knob having a threaded projection where said threaded projection is disposed for threadingly engaging said threads in said chamber whereby said knob closes said end of said chamber;

a weight positioned in said chamber, said weight extending from said disk towards said knob;

a resilient member positioned between said threaded projection of said knob and said insert, said resilient member bearing against said insert to keep said insert from moving in said chamber.

* * * * *